United States Patent [19]

Zanetti-Streccia

[11] 4,087,022

[45] May 2, 1978

[54] DEVICE FOR DISPENSING A TOILET SOLUTION

[76] Inventor: Giuseppe Zanetti-Streccia, Bruckfeldstrasse 11, 3012 Berne, Switzerland

[21] Appl. No.: 678,370

[22] Filed: Apr. 19, 1976

[30] Foreign Application Priority Data

Apr. 30, 1975 Switzerland ..... 5570/75

[51] Int. Cl.[2] ..... B65D 83/14

[52] U.S. Cl. ..... 222/183; 222/184; 222/205; 222/402.13

[58] Field of Search ..... 222/205, 183, 184, 402.13; 401/118, 190

[56] References Cited

U.S. PATENT DOCUMENTS

| | | | |
|---|---|---|---|
| 1,632,473 | 6/1927 | Greenland | 222/205 X |
| 2,700,578 | 1/1955 | Efford | 222/183 X |
| 2,774,517 | 12/1956 | Teegardin et al. | 222/205 |
| 3,128,916 | 4/1964 | Picot | 222/183 |
| 3,456,851 | 7/1969 | Mattes et al. | 222/205 |
| 3,744,678 | 7/1973 | Beres et al. | 222/205 |
| 3,792,802 | 2/1974 | Gores | 222/402.13 |
| 3,841,532 | 10/1974 | Gores | 222/402.13 X |
| 3,862,806 | 1/1975 | Brown | 401/118 |

*Primary Examiner*—Robert B. Reeves
*Assistant Examiner*—Frederick R. Handren
*Attorney, Agent, or Firm*—Imirie, Smiley & Guay

[57] ABSTRACT

The invention relates to a dispensing device comprising a body containing a pressurized container and an actuator which controls the spraying of a determined quantity of product which wets a piece of toilet-paper pressed against the top surface of the actuator, permitting moist cleaning at the appropriate spot.

1 Claim, 6 Drawing Figures

DEVICE FOR DISPENSING A TOILET SOLUTION

The present invention relates to a dispensing device comprising a body and an actuator which controls the spraying of a determined quantity of product.

The aim of the device is to obtain a suitable dispenser permitting the use of a wet piece of toilet-paper at the appropriate spot.

The substances, such as medicaments, disinfectants, sanitary products or any other ingredients, are dispensed in the form of an aerosol or foamed cream.

One already knows an aerosol dispenser for applying a medicine on the skin, comprising a pressurized can including a valve and an actuator mounted on an upwards projecting stem on the valve; the upper surface of the actuator forms an edge which limits the opening of a spray-dome. If the edge of the spray-dome is put against the skin and pressed down, a certain amount of product is delivered.

It is not possible to use any kind of such prior art device because the dispensing device has an insufficient height and cannot be placed firmly on an adjacent supporting surface such as the floor. Furthermore, it is quite difficult to exchange the pressurized can.

It is an object of the present invention to provide a simple and convenient dispensing device whereby the body stands firmly of the supporting surface and by placing a piece of absorbing means on the actuator and by pressing down said actuator, a certain amount of product is spraying and wetting the absorbing means.

Additional objects and advantages of the present invention will become apparent upon consideration of the following description in conjunction with the accompanying drawings in which.

Figure 1:
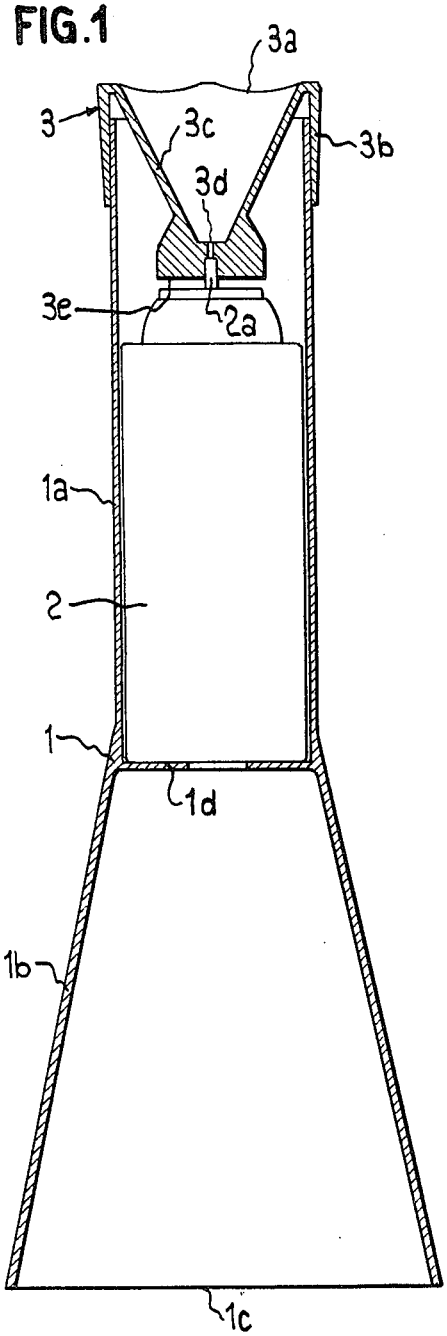
FIGS. 1 and 2 are transverse sectional elevations showing two forms of the dispensing device according to the invention.

A first embodiment of the invention is illustrated in FIG. 1 wherein a dispenser is shown comprising a body 1, made of injected synthetic material or the like, having a hollow truncated base 1*b* extended by a cylindrical part 1*a*. The dimensions of the bottom edge surface 1*c* of the base assure a firm position on supporting surface such as the floor. The surface 1*c* may be coated by a layer of non-slipping material (for instance felt, rough surface).

The inner diameter of the tube 1*a* corresponds to that of a pressurized container such as a can 2 having an upstanding valve stem 2*a*. An actuator 3, having an uneven surface 3*a*, which can be made as a single rigid moulding is secured to the stem of the valve 2*a* of the pressurized can 2 and includes a skirt portion 3*b* which can slide freely on the outer diameter of the tube 1*a* and a spray-cone 3*c* the top-angle of which is larger than the spray cone angle of the substance to be sprayed. An axial dispensing passage 3*d* lets the spray-cone 3*c* communicate with the interior of the valve stem which is normally biased upwards by a spring or other means. The movement of the actuator 3 is guided by the skirt 3*b* and limited by the bottom surface 3*e* of the cone 3*e* which abuts against the top-surface of the can.

One assembles an actuator 3 and a pressurized can 2 the whole being inserted into the tube 1*a* with the skirt portion 3*b* engaging the outer diameter of the tube 1*a*. A transverse wall 1*d*, which may be perforated to permit escape of air upon insertion of can 2, determines the vertical position at rest of the assembled parts 2 and 3. An empty pressurized can 2 may also be easily replaced.

The body 1 is some 20 inches high, more than twice the height of a standardized can.

The dispensing device is of easy use and is placed in a lavatory adjacent the toilet or commode. The top surface of the spray-cone 3*c* is covered with a piece of toilet-paper by an operator seated on the commode, the actuator pressed down permitting a certain amount of substance to be sprayed out through the passage 3*d* and the spray-cone 3*c* onto the absorbing paper which permits after having been wetted moist cleaning.

One may consider the use of other absorbing means.

The uneven top surface 3*a* of the spray-dome permits correct spraying; the inside of the spray-cone 3*c* communicates with the outside.

The sprayed substance does not get into contact with the walls of the cone thanks to the choice of its angle on the apex. However, holes may be provided, close to the passage 3*d*, to evacuate the substance or the liquid which might possibly have accumulated at the bottom of the cone 3*c*; these openings can also serve as vent-holes in the place of the uneven surface 3*a*.

Figure 2:
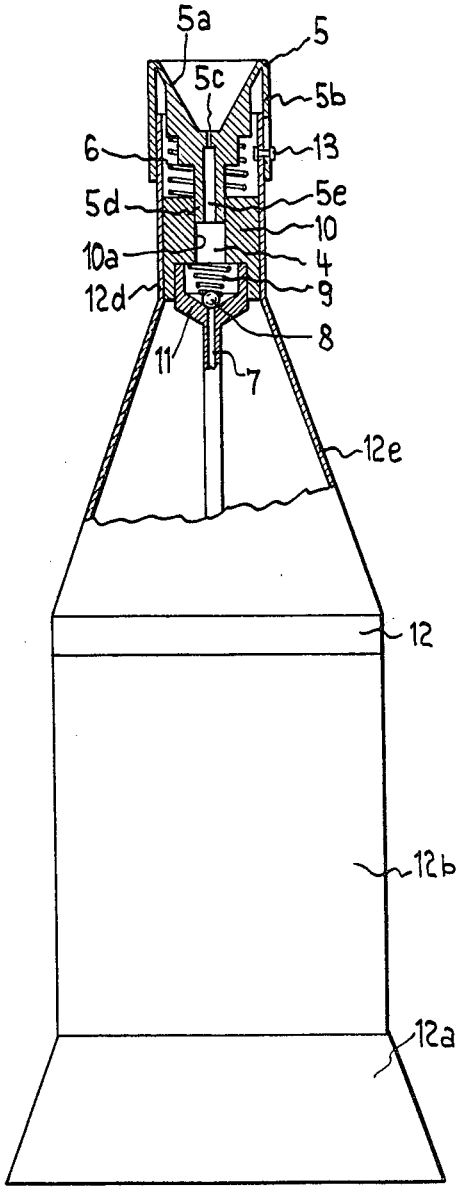
Figure 3:
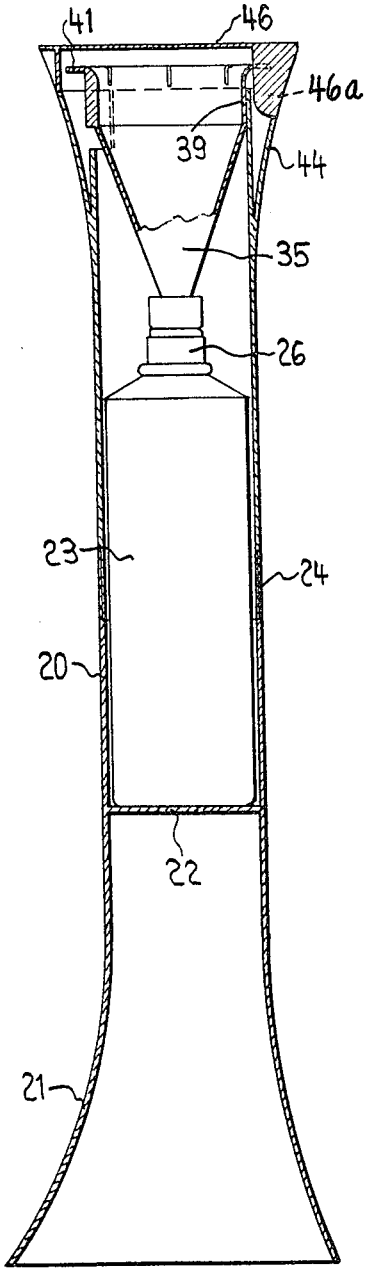
FIG. 3 is a transverse sectional elevation of another embodiment according to the invention.

The dispensing device shown in FIG. 2 differs essentially from that one in FIG. 1 in that the pressurized can 2 is replaced by a deformable container (not shown) and means to maintain the liquid products under quasi-constant pressure.

The container is mounted on one end of a vertical tubular stem 7, the other end of which being extended by a valve core 11 fixed into a drill-hole of a plug 10 locked to the body 12. In idle position a ball 8, pressed by a spring 9, closes the opening of the stem 7.

The actuator 5 comprises, in addition to the spray-cone 5*a* and the guide 5*b* serving the same purpose as described before, a lower portion 5*d* sliding in a reaming or base 10*a* of the plug 10. A passageway 5*e* and a discharge orifice 5*c* let a chamber 4 in the lower portion of the base 10*a* communicate with the spray-cone 5*a*. A pin 13 limits, in both ways, the vertical movement of the actuator 5. The spring 6 positions the actuator (in idle position) whilst the chamber 4 is filled with the liquid.

By pressing on the actuator 5, the lower part 5*d* acting as piston expels the liquid contained in the chamber 4 through the discharge orifice 5*c*; under the effect of the pressure the ball 8 closes tightly the exit of the pipe 7. Vent-holes, not shown, facilitate the spraying.

Releasing the actuator, the spring 6 reaches again its normal position, the ball 8 is released and the liquid fills the chamber 4 up again.

The body 12 of the dispensing device comprises a base 12*a*, a tubular part 12*b* and a truncated part 12*e* extended by a tube 12*d*. The tubular part 12*b* contains the reserve liquid.

The means maintaining the product under constant pressure comprise a spring compressing a flexible container and compensating the weight of the used product.

It is also possible to consider a double action pump with a piston integral with the actuator 5; pressure on the actuator by sprays a certain amount of liquid, by releasing said actuator refills the chamber 4.

The use of the dispensing device is the same as described before. This embodiment permits to stock a great quantity of product in the dispensing device and to eliminate the disadvantages of exchanging too often the pressurized can; this low-priced embodiment is suitable for hospitals.

With reference to FIGS. 3 to 6 the preferred embodiment of the dispensing device shown therein comprises a body having a tubular part 20 extended by a widened base 21 having a triangular section for the stability of the device. A transverse wall 22 supports a pressurized can 23. In order to facilitate the exchange of the pressurized can 23, the tubular part 20 may comprise two aligned portions engaged at a joint 24.

Figure 4:
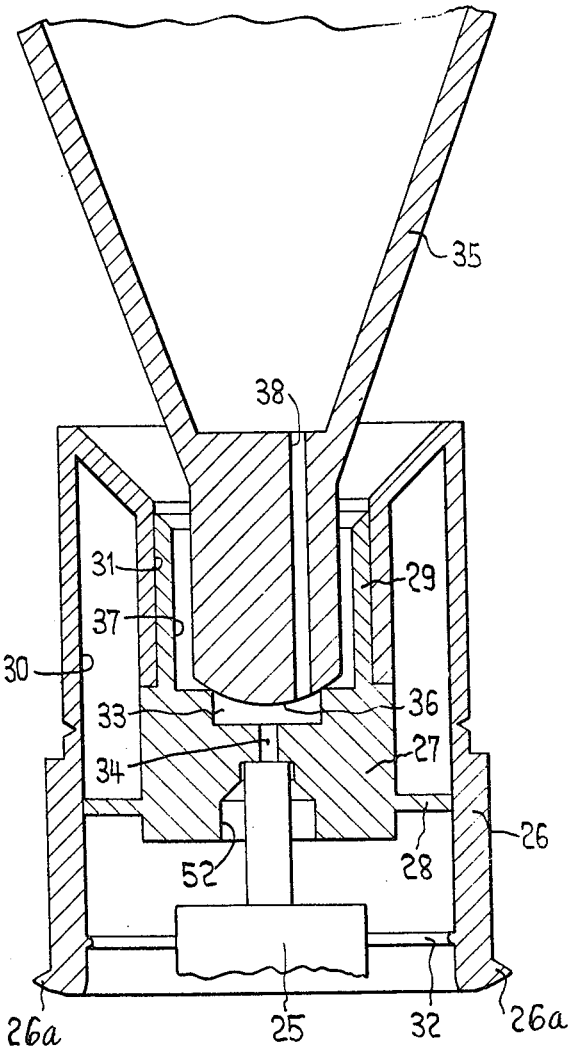
FIGS. 4 and 5 are enlarged details of FIG. 3.

FIG. 4 shows the details of the moving parts cooperating with the dispensing valve 25 of the pressurized can 23. A tubular guide 26 is fitted to the pressurized can 23 by means of an annular lip **26*a* which clamps below the peripheral shoulder of the can 23. A small piston 27 can be moved vertically in the tubular guide 26, the peripheral rib 28 and the annular part 29 being freely adjusted in the cylindrical cavities 30 and 31. A rib 32 maintains the small piston 27 inside the guide 26** when it is not fitted on a can.

The stem of the dispensing valve 25 enters the drill-hole 52 which communicates, by means of a passageway 34, with a chamber 33 and a second chamber 37 having a larger diameter.

The hemispherical end 36 of the tip of the actuator 35 (having the same function as the part 3 of FIG. 1) rests against the upper edge of the chamber 33 which is tightly closed by pressing down on the actuator; the chamber 33 communicates with the inside of the spray-cone with at least one dispensing passage 38 (which can be decentred relating to the axis).

Figure 5:
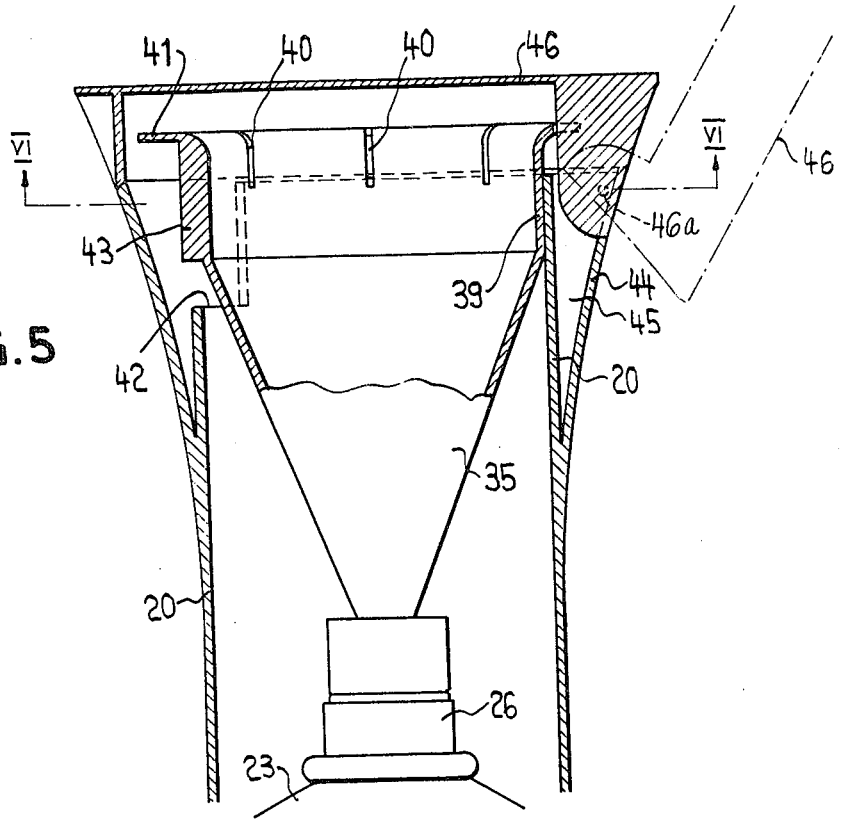
Figure 6:
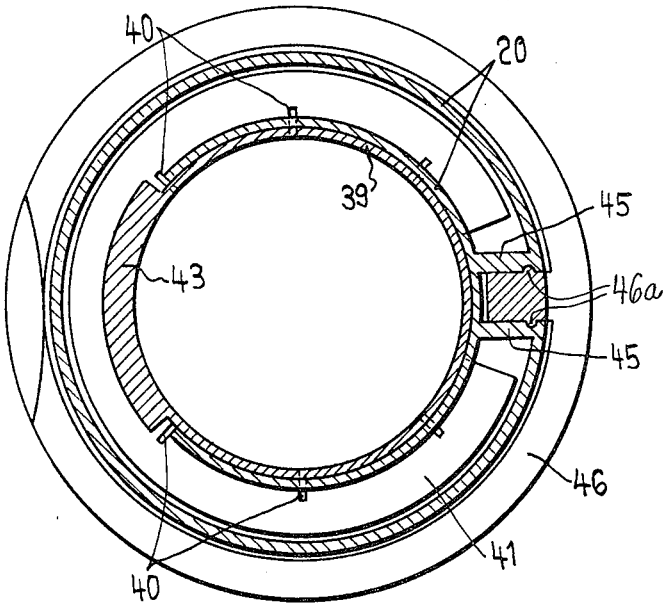
FIG. 6 is a sectional plan view taken on line VI-VI of FIG. 5.

The actuator 35 comprises a tubular part 39 and a flange 41, FIG. 5, for pressure engagement by the absorbing means. The captivated air in the spray-cone escapes through the slits 40 in the tube 39 and flange 41 in order to have an efficient projection of the substance.

The actuator slides on the internal diameter of the tubular part 20; a rib 43 cooperating with an opening 42 prevents the rotation of the actuator.

On the top the tube 20 ends by a bell-shaped part bound by ribs 45. A cover 46 rotating on a fulcrum **46*a*** closes and protects the device against dust.

The use of this dispensing device is the same as previously described.

In a simplified embodiment of the invention the body may be the pressurized can itself; this embodiment is similar to the one illustrated in FIG. 1, the cylindrical part **3*b* being longer in order to guide the actuator 3 on the external diameter of the pressurized can 2**.

I claim:

1. A dispensing device comprising a body including a cylindrical part for removably receiving a pressurized container having an upstanding valve stem and a peripheral shoulder, an actuator movably mounted on the upper part of said body for engagement with the container valve stem to control the spraying of a determined quantity of product from the container, a hollow truncated base extended downwardly from said cylindrical part to support said actuator at an elevated position, said cylindrical part comprising two aligned separable portions to facilitate exchange of the pressurized container, said actuator comprising a spray cone having vent holes, the movement of said actuator being guided by the cylindrical part of said body, said actuator having a tip located to be centered on the axis of the valve stem, said actuator including a piston sliding in a tubular guide fitted on the peripheral shoulder of the pressurized container, said actuator also defining a chamber and at least one dispensing passageway between said chamber and spray cone for passage of the sprayed substance into said spray cone.

* * * * *